US006615916B1

(12) United States Patent
Vachon

(10) Patent No.: US 6,615,916 B1
(45) Date of Patent: Sep. 9, 2003

(54) METHOD OF SAVING STRING OF TOOLS INSTALLED IN AN OIL WELL AND A CORRESPONDING TRANSMISSION ASSEMBLY

(75) Inventor: Guy Vachon, Austin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/890,735

(22) PCT Filed: Jan. 26, 2000

(86) PCT No.: PCT/EP00/00592

§ 371 (c)(1),
(2), (4) Date: Jan. 29, 2002

(87) PCT Pub. No.: WO00/46616

PCT Pub. Date: Aug. 10, 2000

(30) Foreign Application Priority Data

Feb. 5, 1999 (FR) ..... 99 01368

(51) Int. Cl.[7] ..... E21B 47/12; E21B 47/01; G01V 3/00

(52) U.S. Cl. ..... 166/250.01; 166/65.1; 340/853.1; 340/853.2

(58) Field of Search ..... 166/250.01, 65.1, 166/53, 378, 385, 380; 340/853.1, 853.2, 853.3, 853.7

(56) References Cited

U.S. PATENT DOCUMENTS

| | | | | | |
|---|---|---|---|---|---|
| 4,157,535 | A | * | 6/1979 | Balkanli | 340/853.3 |
| 4,468,665 | A | * | 8/1984 | Thawley et al. | 340/853.2 |
| 4,862,425 | A | * | 8/1989 | Cretin et al. | 367/33 |
| 5,995,020 | A | * | 11/1999 | Owens et al. | 340/854.9 |
| 6,420,976 | B1 | * | 7/2002 | Baggs et al. | 340/853.3 |
| 6,469,636 | B1 | * | 10/2002 | Baird et al. | 340/854.9 |
| 2001/0027864 | A1 | * | 10/2001 | Vaynshteyn | 166/250.01 |

* cited by examiner

*Primary Examiner*—David Bagnell
*Assistant Examiner*—Shane Bomar
(74) *Attorney, Agent, or Firm*—Martin Hyden; Brigitte L. Jeffery; John J. Ryberg

(57) ABSTRACT

In order to ensure that at least some of the tools (12-1) to 12-4) in a string of tools that is permanently installed in an oil well (10) are kept in operation even in the event of a localized fault, the link (18) interconnecting the tools and a surface installation (16) is subdivided into segments by switch members (20). More precisely, a switch member is associated with each tool. In addition, the link (18) forms a loop with both ends thereof being connected to the surface installation (16).

8 Claims, 2 Drawing Sheets

METHOD OF SAVING STRING OF TOOLS INSTALLED IN AN OIL WELL AND A CORRESPONDING TRANSMISSION ASSEMBLY

TECHNICAL FIELD

The invention relates to a method designed to enable at least a portion of a string of tools permanently installed in an oil well such as a production well to be saved in the event of a fault localized on one of the tools or on an electric cable connecting a surface installation to each of the tools in series.

The invention also relates to a transmission assembly including an electric cable connecting a surface installation in series to each of the tools of a string of tools installed permanently in an oil well, and organized so as to enable such a method to be implemented.

STATE OF THE ART

In an oil well, a string of tools is generally installed permanently for the purpose of measuring and controlling various characteristic magnitudes of the well. Such a string of tools comprises a certain number of tools disposed in the well one above another at determined depths. Each tool is independent of the others and is provided in particular with means for measuring one or more magnitudes, or with means for controlling the flow of petroleum fluid along the well, or indeed with measurement means and with associated control means.

As a general rule, an electric cable connects a surface installation in series to each of the tools in a string of tools constituted in this way. The electric cable serves both to feed electricity to each of the tools and to transmit electrical signals from the surface installation to each of the tools, and vice versa.

In an existing arrangement, the link comprises two twisted conductors housed in a stainless steel tube. In the surface installation, and also in each of the tools, signals are transmitted and received via a transformer. Electrical power is then supplied in common mode.

In that arrangement, which is characterized by a serial electrical link between the surface installation and the various tools, an interruption of an electrical conductor or the appearance of a short circuit will have the consequence of making the entire string of tools inoperative.

U.S. Pat. No. 4,398,271 describes a system for transmitting data in a seismic streamer comprising a number of links, each of which includes switch means. In use, the switch means are set to one of a number of possible positions to isolate discontinuities and form a continuous data path.

SUMMARY OF THE INVENTION

A specific object of the invention is to provide a method enabling at least a portion of a string of tools installed in an oil well to be saved in spite of a short circuit or an interruption occurring in the cable or in one of the tools.

According to the invention, this result is obtained by means of a method of saving a string of tools installed in an oil well in the event of a localized fault, a link connecting a surface installation in series with each of the tools of said string, the method being characterized in that it consists in subdividing the link into segments that are successively interconnected by switch means, in locating a fault, if any, by closing each of the switch means one after another starting from the surface installation until said fault appears, and in closing only those switch means that precede the last-closed switch means.

Because of the presence of switching means on the link, it becomes possible to save that portion of the string of tools which is situated above the location where the fault has occurred, by leaving open the lowest switching means connecting the surface installation to the faulty tool or segment.

In a preferred implementation of the invention, a link is used that forms a loop between the surface installation and the tools. Said fault is located by closing the switch means in both directions along said loop from the surface installation, and in each direction only the switch means preceding the last-closed switch means are closed.

Preferably, switch means are associated with each of the tools.

Advantageously, each tool is caused to communicate separately with each of the two segments that are interconnected by the switch means associated with said tool.

By means of these characteristics in combination, it is possible either to keep all of the tools in operation when the fault has occurred on a segment interconnecting two tools, or else to put only one of the tools out of circuit when the fault has occurred within said tool.

In a preferred implementation of the invention, the link comprises an electric cable. In which case, advantageously, the tools are powered in common mode while signals are simultaneously being interchanged between the surface installation and each of the tools over a two-conductor cable.

The invention also provides a link connecting a surface installation in series with each of the tools of a string of tools installed in an oil well, which assembly is characterized in that the link is made up of successive segments that are interconnected by switch means suitable for being opened to isolate at least one faulty tool or cable segment.

BRIEF DESCRIPTION OF THE DRAWINGS

A preferred embodiment of the invention is described below by way of non-limiting example with reference to the accompanying drawings, in which.

DETAILED DESCRIPTION OF A PREFERRED EMBODIMENT OF THE INVENTION

Figure 1:
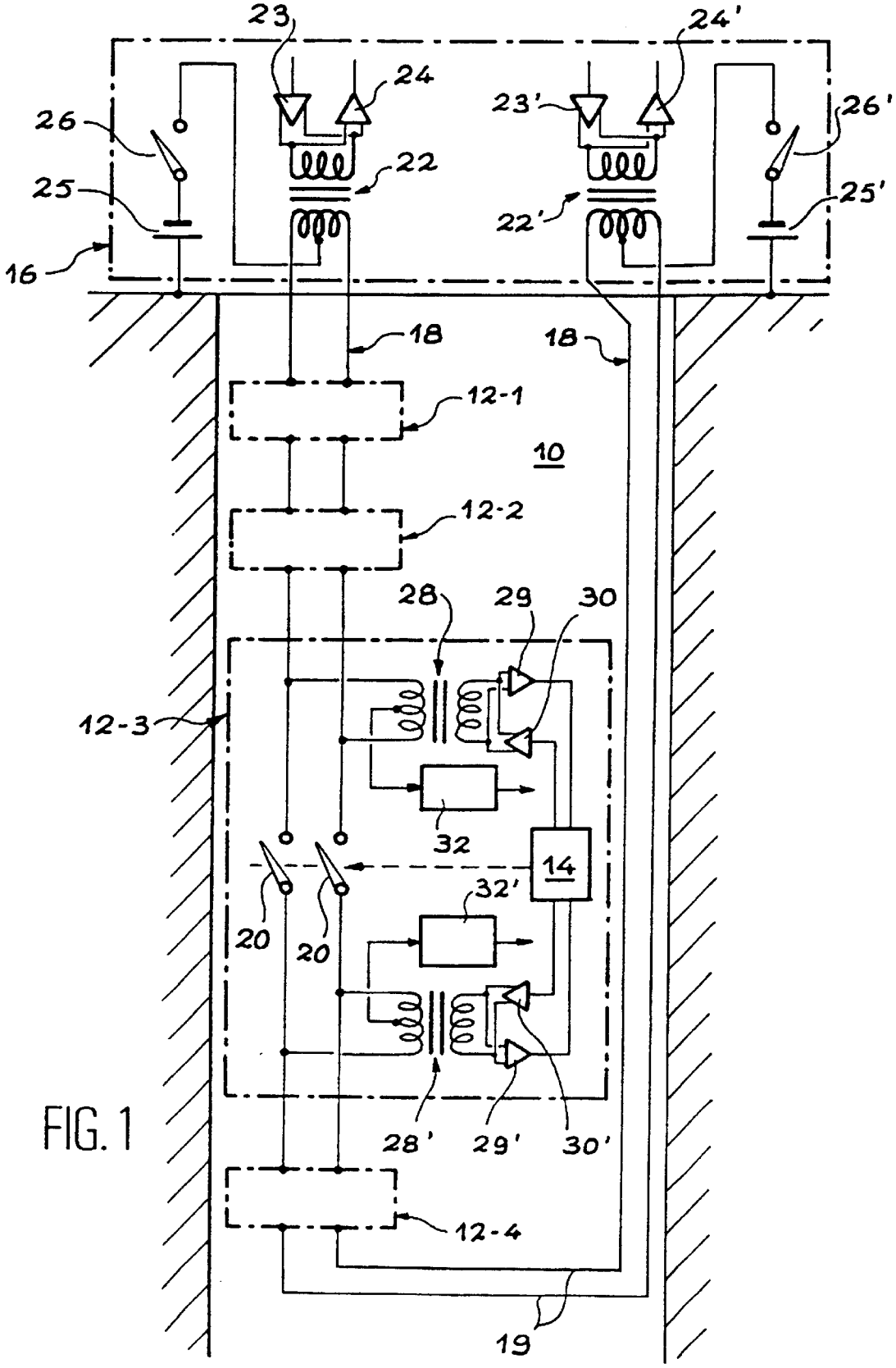
FIG. 1 is a diagrammatic vertical section view showing a transmission assembly of the invention associated with a string of tools permanently installed in a borehole.

In FIG. 1, reference 10 designates an oil well in production.

A string of tools is placed in the oil well 10 to perform measurement and control therein for well-operating purposes. In the embodiment shown by way of example, the string of tools comprises four tools numbered 12-1 to 12-4 starting from the surface and installed in the well at different depths, one above another.

As shown for the tool 12-3 only, in order to simplify FIG. 1, each of the tools 12-1 to 12-4 has an active portion 14. Depending on the nature of the tool in question, the active portion 14 may have one or more sensor(s), one or more actuator(s), or both sensors and actuators. The tool also includes an electronics module serving to transmit signals in one direction or the other and also to transmit various commands.

The tools 12-1 to 12-4 are interconnected and are also connected to a surface installation 16 by means of an electric cable 18. In the embodiment shown, the electric cable 18 has two, preferably twisted-together, electrical conductors 19 disposed inside a stainless steel tube (not shown) for protecting the electrical conductors 19.

More precisely, the link 18 connects the surface installation 16 in series to each of the tools 12-1 to 12-4, and in this case does so in the same order as the order in which the tools were installed inside the well 10.

As shown solely for the tool 12-3, to simplify the figure, switch means 20 are associated with each of the tools 12-1 to 12-4 so as to subdivide the link 18 into successive segments that are interconnected by the switch means 20.

In the embodiment shown where the cable 18 has two electrical conductors 19, each of the switch means 20 has two switches each located in a respective one of the electrical conductors.

At a first end of the cable 18, the two electrical conductors 19 are connected to the secondary winding of a transformer 22 that forms part of the surface installation 16. The primary winding of the transformer. 22 is connected to signal transmitter means 23 and receiver means 24.

The surface installation 16 also has a common mode electrical power supply source 25 connected to the midpoint of the secondary winding of the transformer 22. Means for closing the electrical power supply circuit are represented diagrammatically by a switch 26.

As shown solely for the tool 12-3, to simplify FIG. 1, each of the tools 12-1 to 12-4 includes a transformer 28 whose primary winding is electrically connected between the electrical conductors 19 of the cable 18, upstream from the switch means 20 of the tool in question, i.e. vertically towards the top of the well relative to said switch means. The secondary winding of the transformer 28 fitted to each of the tools is electrically connected to the active portion 14 associated with said tool via transmitter means 30 and receiver means 29.

Each transformer 28, in association with the link 18, thus serves to transmit signals between the surface installation 16 and the tool in question. More precisely, each transformer 28 serves to transmit signals from the surface installation 16 to the active portion 14 of the corresponding tool. Conversely, each transformer 28 also serves to transmit signals from the corresponding tool 12-1 to 12-4 to the surface installation 16.

In addition, each of the tools 12-1 to 12-4 has an electrical power supply circuit 32 connected to the midpoint of the primary winding of the transformer 28 associated with the tool. The assembly thus makes it possible to power each of the tools 12-1 to 12-4 in common mode from an electrical power supply source 25 located in the surface installation 16.

The transmission assembly described above makes it possible, in the event of a short circuit or of an interruption occurring in one of the tools or in one of the segments of the cable 18 between two tools, to save all of the tools that are situated above the faulty element.

Thus, assuming that a short circuit or an interruption has occurred on the segment of cable 18 that interconnects the tools 12-3 and 12-4, then the tools 12-1 to 12-3 can be kept in action by closing the switch means associated with the tools 12-1 and 12-2 and by opening the switch means 20 associated with the tool 12-3. In which case only the tool 12-4 is inoperative.

Assuming that the interruption or short circuit has taken place inside one of the tools, such as the tool 12-3, then all of the tools situated thereabove can continue to be used, by leaving the switch means 20 associated with the tool 12-2 open and by closing the switch means associated with the tools situated thereabove, i.e. in this case the tools 12-1. On this assumption, all of the tools situated above the faulty tool can continue to be used, while the faulty tool and the tools situated beneath it are inoperative.

In the absence of a fault, all of the switch means 20 are normally closed, as is the switch 26. Under such circumstances, all of the tools 12-1 to 12-4 are operative.

When a fault occurs, it is immediately detected by the signal transmitter means 23 and receiver means 24 connected to the secondary winding of the transformer 22. A command to open the switch 26 and all of the switch means 20 is then issued.

The fault is then located by closing the switch means 20 associated with each of the tools 12-1 to 12-4 one after another until the fault reappears.

More precisely, signals are sent to the first tool 12-1 from the surface to find out whether it is operating properly. When the surface installation receives signals confirming such proper operation, the switch means 20 associated with this first tool are closed.

If this closure causes the fault to reappear, then the fault is located either in the segment of cable 18 interconnecting the tools 12-1 and 12-2, or else in the tool 12-2. Under such circumstances, none of the switch means 20 can be kept in the closed state, and only the tool 12-1 remains usable.

Otherwise, i.e. if no fault occurs when the switch means 20 associated with the first tool 12-1 is closed, then the operations previously performed on the tool 12-1 are repeated on the following tool 12-2. When the tool 12-2 is found to be in working order, the corresponding switch means 20 are closed.

As before, this closure can either cause the fault to reappear, or can give rise to no new fault.

These operations are repeated step by step until the fault is indeed located. After the previously closed switch 26 and switching means 20 have been opened again, the switch 26 is reclosed as are all of the switch means 20 preceding the previously last-closed switch means that led to the fault being detected.

In FIG. 1, there is shown a preferred embodiment of the invention which provides considerably more effective tool saving. To this end, the link 18 is not terminated at the deepest tool 12-4, but hereafter rises back up the well to the surface installation 16. In other words, the link 18 forms a loop going from the surface installation 16 via each of the tools 12-1 to 12-4 in succession, and then returning to the surface installation 16.

In this case, and as shown diagrammatically in FIG. 1, the surface installation 16 is arranged so as to enable the tools 12-1 to 12-4 to be powered and so as to enable signals to be transmitted via either of the two ends of the cable 18 that are connected to the installation 16. To this end, the surface installation 16 has a second transformer 22' whose secondary winding is connected to the second end of the cable 18 and is connected across its two electrical conductors 19. The primary winding of the transformer 22' is connected to signal transmitter means 23' and receiver means 24'.

To enable each of the tools 12-1 to 12-4 to be powered electrically from the second end of the cable 18, the midpoint of the secondary winding of the transformer 22' is electrically connected to an electrical power supply source 25' via means for closing the power supply circuit and represented by a switch 26'.

It should be observed that in practice, the various elements of the surface installation 16 connected to each of the ends of the electric cable 18 can have various portions in common, unlike the diagrammatic illustration of FIG. 1.

In this preferred embodiment of the invention, each of the tools 12-1 to 12-4 also has means enabling electrical power to be delivered and electrical signals to be transmitted downstream of the switch means 20 fitted to the tool in question.

Thus, and as shown solely for the tool 12-3, in order to simplify the figure, each of the tools then includes a second transformer 28' whose primary winding is connected between the two electrical conductors of the cable 18 downstream from the switch means 20 of the tool in question, i.e. beneath the switch means. The secondary winding of each of the transformers 28' is then connected to the active portion 14 of the stage in question via transmitter means 30' and receiver means 29'. This arrangement makes it possible to ensure that signals can be transmitted in either direction between the elements of the surface installation 16 connected to the second end of the cable 18 and the tool in question, even when the switch means 20 of the tool in question are open.

In addition, the midpoint of the primary winding of the transformer 28' associated with each of the tools is connected to electrical power supply means 32' of the tool in question. This arrangement makes it possible to power the tool electrically from the second end of the cable 18 when the switch means 20 fitted to the tool are open.

In this preferred embodiment of the invention, all of the tools can be kept active in the event of a short circuit or an interruption occurring in any one of the segments of the cable 18 interconnecting any two tools 12-1 to 12-4. The switch means 20 of two of the tools such as 12-2 and 12-3 situated at opposite ends of the segment in question are then put into the open state while all of the other switch means are closed. Under such conditions, the tools such as 12-1 and 12-2 situated above the faulty cable segment are powered and electrically connected to the surface installation 16 via the portion of the cable 18 that is situated above the faulty segment. In addition, the tools such as 12-3 and 12-4 that are situated beneath the faulty segment are electrically powered and connected to the surface installation 16 via the other portion of the cable 18, connecting the bottom tool 12-4 to the surface installation.

If the fault lies within one of the tools, such as the tool 12-2, then all of other tools, i.e. in this case the tools 12-1, 12-3, and 12-4, can be kept in working order.

To this end, the switch means 20 associated with the tools adjacent to the faulty tool, such as 12-1 and 12-3 in this case, are kept open while the other switch means 20 are kept closed, e.g. the switch means associated with the tool 12-4, with this being done by acting on the corresponding end of the cable.

The procedure is identical to that described above when the cable 18 does not form a loop. The only exception is that it is effected in this case from each of the two ends of the able 18.

In the embodiment described with reference to FIG. 1, the tools 12-1 to 12-4 of the string of tools installed in the well 10 are connected in series in the same order as that with which they are to be found inside the well. However, in a variant, as shown diagrammatically in FIG. 2, this method of connection is merely one particular non-limiting example.

Figure 2:
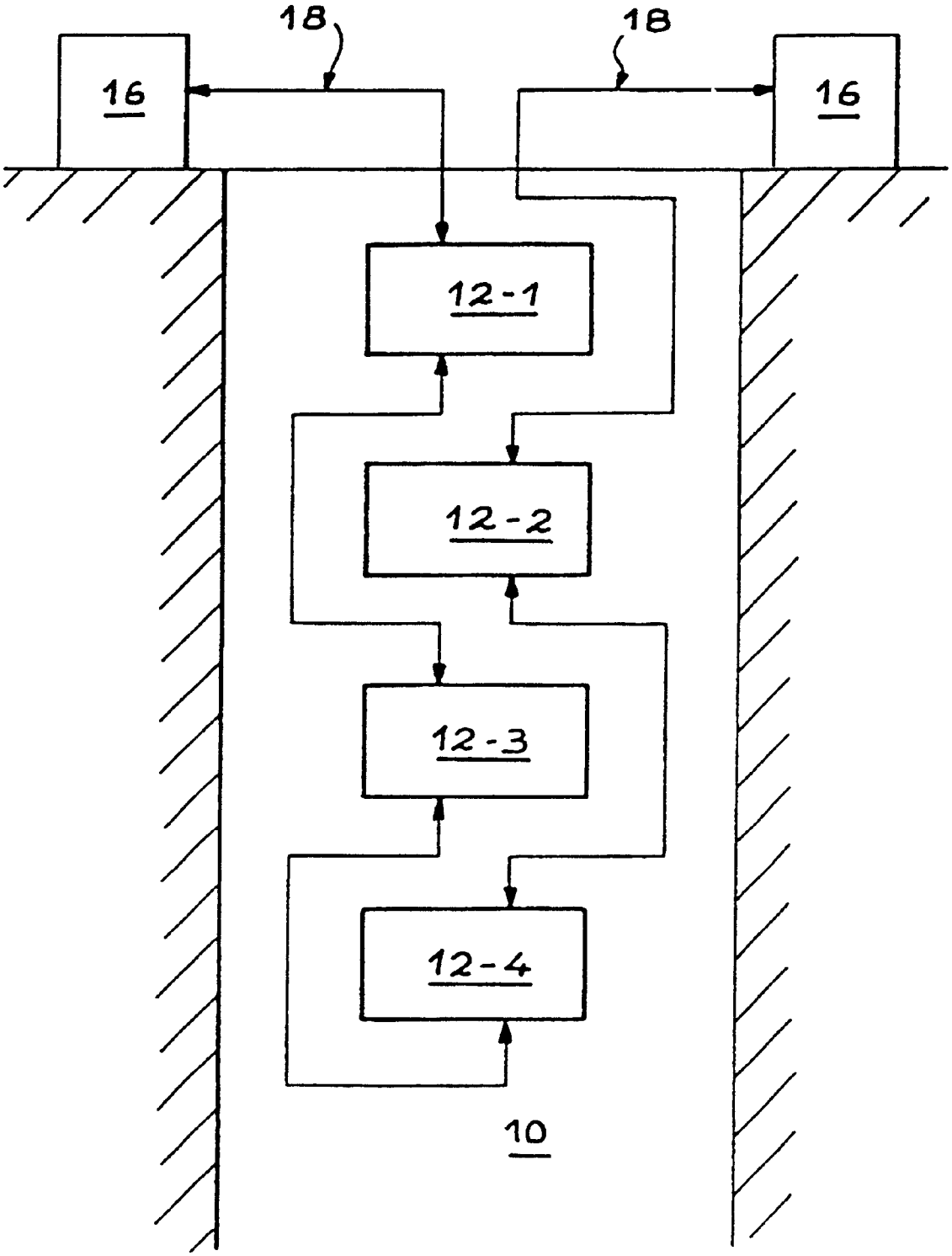
FIG. 2 is a view comparable to FIG. 1, showing a variant implementation of the transmission assembly.

Thus, in FIG. 2, the first end of the cable 18 from the surface installation 16 connects said assembly in series successively to the top tool 12-1, to the tool 12-3, then to the tool 12-4, prior to coming back up the well via the tool 12-2 and up to the surface installation 16.

Any other mode of serial connection involving all of the tools in the string of tools, regardless of how many tools are involved, could be adopted without going beyond the ambit of the invention.

It should be observed that although it is preferred to power all of the tools in common mode as described above, it is also possible to power the tools separately from signal transmission by providing the cable with a third electrical conductor. Under such circumstances, each switch means will also have a switch placed in said third conductor.

On the same lines, the technique used for transmitting signals between the surface installation and each of the tools can also be replaced by any equivalent technique without going beyond the ambit of the invention.

Finally, the invention is not limited to the case where the tools and the surface installation are interconnected by an electric cable. On the contrary, it applies to any type of link, for example a hydraulic link.

What is claimed is:

1. A method of saving a string of tools installed in an oil well in the event of a localized fault, a link (18) being used to form a loop between a surface installation (16) and each of the tools (12-1 to 12-4) of said string, the method comprising the steps of:

subdividing the link (18) into segments that are successively interconnected by switch means (20), locating a fault, if any, by closing each of the switch means (20) one after another in both directions along said loop starting from the surface installation (16) until said fault appears, opening said switch means (20) again, and re-closing in each direction only those switch means (20) that precede the switch means last closed before the fault appeared.

2. A method according to claim 1, in which each tool (12-1 to 12-4) is caused to communicate separately with each of the two segments that are interconnected by the switch means (20) associated with said tool.

3. A method according to claim 1, in which said link comprises an electric cable (18).

4. A method according to claim 3, in which tools are powered in common mode while signals are simultaneously interchanged between the surface installation (16) and each of the tools (12-1 to 12-4) over a two-conductor cable (18).

5. A transmission assembly, comprising:

a surface installation (16), a series of tools (12-1 to 12-4) connected in series to the surface installation (16) by means of a link (18) made up of a series of successive segments interconnected by switch means (20) capable of isolating a faulty segment; wherein the tools (12-1 to 12-4) are permanently installed in an oil well (10), and the link (18) forms a loop and provides both power and signals between the tools (12-1 to 12-4) and the surface installation (18).

6. An assembly according to claim 5, wherein each tool (12-1 to 12-4) communicates separately with each of two adjacent segments interconnected by the switch means (20) associated with said tool.

7. An assembly according to claim 5, in which said link comprises an electric cable (18).

8. An assembly according to claim 7, in which the cable (18) has two conductors and the surface installation (16) has a transformer (22, 22') whose primary winding is connected to signal transmitter and receiver means and whose secondary winding is connected in series between the two conductors of the cable, the surface installation (16) also comprising an electricity source (25, 25') connected to the midpoint of the secondary winding.

* * * * *